US008651450B2

(12) United States Patent
Sollars

(10) Patent No.: US 8,651,450 B2
(45) Date of Patent: Feb. 18, 2014

(54) ADJUSTABLE AND REUSABLE BRACE, KICKER AND TIE APPARATUS

(76) Inventor: Donald Sollars, Milpitas, CA (US)

( * ) Notice: Subject to any disclaimer, the term of this patent is extended or adjusted under 35 U.S.C. 154(b) by 0 days.

(21) Appl. No.: 13/146,395

(22) PCT Filed: Feb. 1, 2010

(86) PCT No.: PCT/US2010/022775

§ 371 (c)(1),
(2), (4) Date: Jul. 26, 2011

(87) PCT Pub. No.: WO2010/088628

PCT Pub. Date: Aug. 5, 2010

(65) Prior Publication Data

US 2011/0285044 A1 Nov. 24, 2011

Related U.S. Application Data

(60) Provisional application No. 61/148,853, filed on Jan. 30, 2009.

(51) Int. Cl.
*E04G 11/08* (2006.01)

(52) U.S. Cl.
CPC ..... *E04G 11/08* (2013.01)
USPC ..... 249/194; 249/210; 249/213

(58) Field of Classification Search
USPC ..... 249/2, 3, 4, 5, 6, 7, 209, 212, 194, 210, 249/213; 52/127.2; 248/354.1, 354.3, 248/354.4, 354.5, 354.6
See application file for complete search history.

(56) References Cited

U.S. PATENT DOCUMENTS

| | | | | |
|---|---|---|---|---|
| 2,511,584 | A * | 6/1950 | Hill | 249/27 |
| 3,195,852 | A | 7/1965 | Lundell | |
| 3,428,287 | A * | 2/1969 | Redding et al. | 249/13 |
| 3,817,006 | A | 6/1974 | Williams | |
| 5,782,050 | A | 7/1998 | Boeshart | |
| 6,976,339 | B1 * | 12/2005 | Riccio et al. | 52/127.1 |

OTHER PUBLICATIONS

International Search Report and Written Opinion for PCT/US2010/022775, mailed Apr. 8, 2010.

* cited by examiner

*Primary Examiner* — Michael Safavi
(74) *Attorney, Agent, or Firm* — Schwabe, Williamson & Wyatt, P.C.

(57) ABSTRACT

Embodiments of an adjustable and reusable brace, kicker and tie apparatus are disclosed herein. Various embodiments include a bracing arrangement for bracing an inner and an outer form for forming a concrete structure. In various embodiments, the bracing arrangement may include interior and exterior vertical bracing members and a horizontal tie member removably and/or adjustably couple the vertical brace members at respective top or bottom ends of the vertical brace members. In various embodiments, a pair of bracing arrangements may share an exterior vertical brace member, which may be angled, for providing support at a corner of a form. In various embodiments, various bracing arrangement may be employed to form a bracing cage. The bracing arrangements may be constituted with material or materials designed for reusability.

18 Claims, 13 Drawing Sheets

ADJUSTABLE AND REUSABLE BRACE, KICKER AND TIE APPARATUS

RELATED APPLICATION

This Patent Cooperation Treaty (PCT) application claims priority to U.S. provisional application 61/148,853, entitled "Adjustable and/or Reusable Brace, Kicker and Tie Apparatus," filed Jan. 30, 2009. For U.S. national stage, the specification of the provisional application is incorporated herein by reference, to the extent it is consistent with this specification.

TECHNICAL FIELD

Embodiments relate to the field of construction, in particular, to a brace, kicker and tie apparatus for supporting a form for forming concrete structures.

BACKGROUND

Concrete structures, such as retaining walls, are typically formed by defining cavities corresponding to the concrete structures, pouring concrete in liquid form into the cavities, allowing the concrete to solidify, and after formation, dismantling the form and its supporting structures. Each cavity defining form typically involves inner and outer form walls, hereinafter simply inner and outer forms, formed using e.g. sheets of plywood. The inner and outer forms are typically supported by a number of brace and kicker combinations, with the braces respectively supporting the inner and outer forms, and the kickers correspondingly supporting the braces. For certain taller concrete structures employing multiple form panels to form either the inner or outer form, ties may be used to tie the inner and outer forms together to resist the pressure of the concrete.

Wood stakes cut into appropriate lengths are typically used for braces and kickers. The braces are typically secured to the ground and the inner/outer forms are nailed to the braces; likewise, the kickers are driven into the ground or anchored to the ground and nailed to support the braces. A large number of brace and kicker combinations are often required to provide the necessary strength to sustain the form and keep the liquid concrete in place, while the concrete solidifies over time. Wire, bolts, or special purpose hardware is typically used for ties. After the concrete has solidified and the structures have formed, the wooden brace and kicker combinations, along with the ties, are removed, and the forms are dismantled.

Typically, portions of the wood braces are stuck in the concrete, and have to be broken apart before the protruding portions can be removed. The stuck portions are left in the concrete. The process is labor intensive. Further, the approach is wasteful in terms of resource consumption, as the majority of the wood products becomes unusable and turns into land waste.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF EMBODIMENTS

Figure 1:
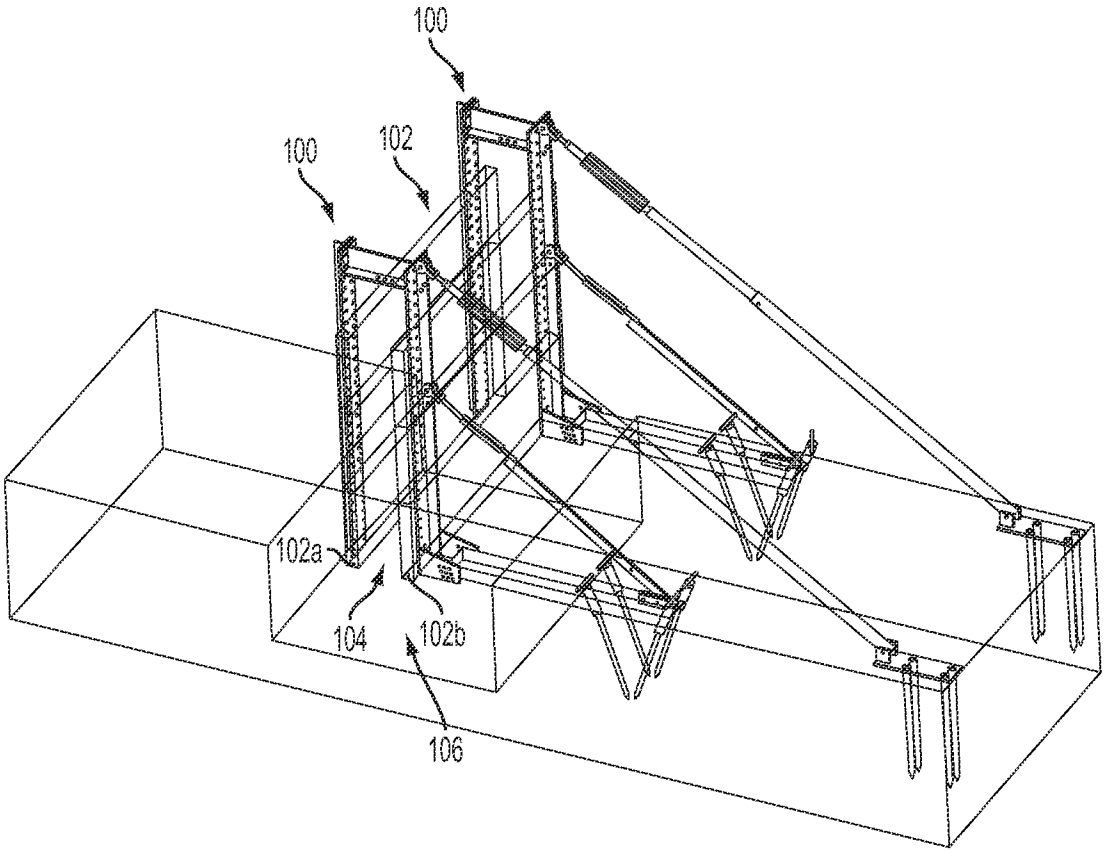
FIG. 1 illustrates a perspective view of a pair of the brace, kicker and tie apparatuses, showing selective elements of the apparatuses.

Embodiments of the brace, kicker and tie apparatus of the present disclosure include bracing means for bracing an inner and an outer form for forming a concrete structure. In various embodiments, the bracing means may include interior and exterior vertical bracing members, and one or more horizontal tie members removably and/or adjustably coupling the vertical bracing members together at respective top or bottom ends of the vertical bracing members. In various embodiments, a pair of bracing means may share an interior or exterior vertical brace member, which may be angled, for providing support at a corner of a form. In various embodiments, the brace, kicker and tie apparatus may further include kicker means for linearly adjustably supporting the bracing means, and means for providing a base for the bracing means and the kicker means. In various embodiments, the bracing means, the kicker means, and the base means may be constituted with material or materials designed for reusability. In various embodiments, the brace, kicker and tie apparatuses may be employed to provide a bracing cage.

In the following detailed description, reference is made to the accompanying drawings which form a part hereof, and in which are shown by way of illustration embodiments in which the invention may be practiced. It is to be understood that other embodiments may be utilized and structural or logical changes may be made without departing from the scope of the disclosure. Therefore, the following detailed description is not to be taken in a limiting sense, and the scope of embodiments is defined by the appended claims and their equivalents.

Various embodiments will be described with references to the side views and/or top views of various components. The various views are to facilitate understanding, and are not limiting on the invention. The terms "substantially," "considerably," "significantly," "largely," may be used, and these terms are intended to be synonyms for each other. The description may use the phrases "in an embodiment," or "in embodiments," which may each refer to one or more of the same or different embodiments. Furthermore, the terms "comprising," "including," "having," and the like, as used with respect to embodiments, are synonymous The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other. For the purpose of this application, wood is not an reusable material for a component or a part, if the component or part is expected to touch concrete in liquid form, as the component or part will be stuck and not removable for reuse after the concrete solidifies.

Various operations may be described as multiple discrete operations in turn, in a manner that may be helpful in understanding embodiments; however, the order of description should not be construed to imply that these operations are order dependent. Also, embodiments may have fewer operations than described. A description of multiple discrete operations should not be construed to imply that all operations are necessary. Also, embodiments may have fewer operations than described. A description of multiple discrete operations should not be construed to imply that all operations are necessary.

For the purposes of the description, a phrase in the form "A/B" means A or B. For the purposes of the description, a phrase in the form "A and/or B" means "(A), (B), or (A and B)". For the purposes of the description, a phrase in the form "at least one of A, B, and C" means "(A), (B), (C), (A and B), (A and C), (B and C), or (A, B and C)". For the purposes of the description, a phrase in the form "(A)B" means "(B) or (AB)" that is, A is an optional element.

Referring now to FIG. 1, wherein a perspective view of a pair of the brace, kicker and tie apparatuses of the present disclosure, showing selective elements of the apparatuses, in accordance with various embodiments, is shown. As illustrated, the pair of brace, kicker and tie apparatus 100 may be employed to support a section of a form 102 for forming a concrete structure, e.g. a retaining wall with an inverted T-shape footing. Form 102 may include inner and outer form walls 102*a* and 102*b*, hereinafter simply inner and outer form, defining cavity 104 over footing 106 for receipt of concrete in liquid form, holding the concrete in liquid form, and allowing the concrete to solidify over time to yield the desired concrete structure.

Figure 2:
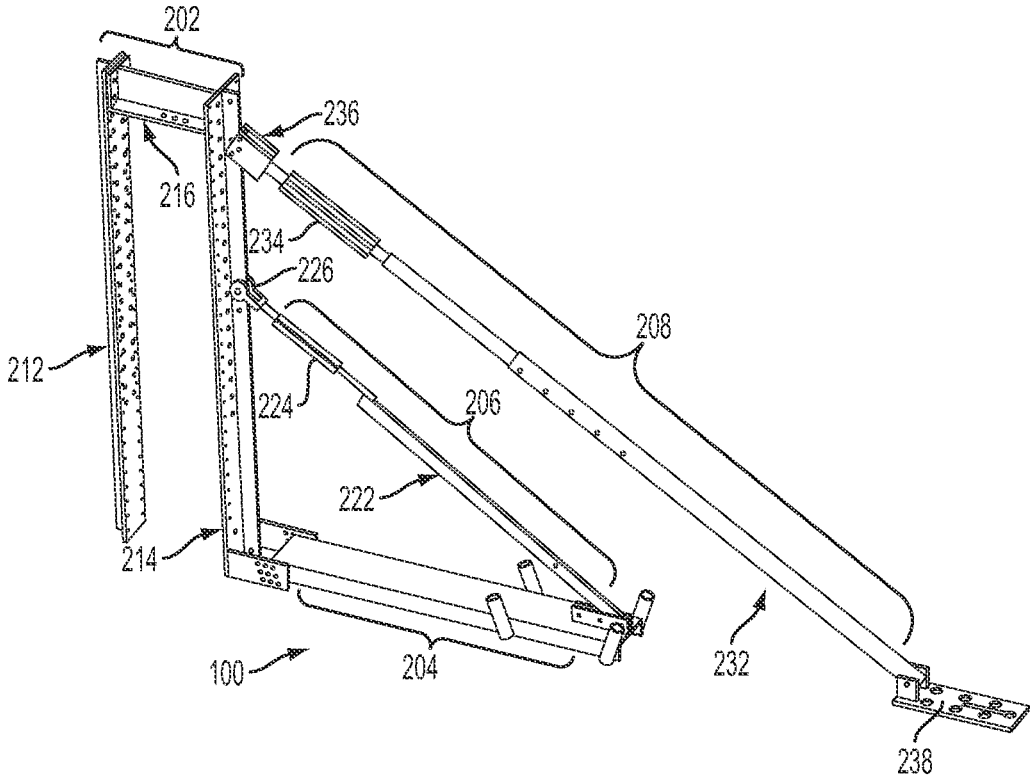
FIG. 2 illustrates a perspective view of one of the brace, kicker and tie apparatuses of FIG. 1, showing selective elements of the apparatus.

Referring now to FIG. 2, wherein a perspective view of one of the brace, kicker and tie apparatuses of FIG. 1, showing selective elements of the apparatus, in accordance with various embodiments, is shown. As illustrated, for the embodiments, brace, kicker and tie apparatus 100 may include a bracing arrangement 202. In various embodiments, apparatus 100 may further include a base 204, a first linearly adjustable kicker 206, and/or a second linearly adjustable kicker 208, removably and adjustably coupled to bracing arrangement 202 and each other as shown. As will be described in more details below, bracing arrangement 202, base 204, first linearly adjustable kicker 206, and second linearly adjustable kicker 208 may be assembled together or disassembled relatively easy, as compared to the prior art, in particular, elements 202-208 may include features designed to provide multiple degrees of freedom for assembly, allowing elements 202-208 to be flexibly coupled together to support forms of various desired dimensions and/or precision.

Bracing arrangement 202 may include interior vertical brace member 212, exterior vertical brace member 214, removably and adjustably coupled together by horizontal tie member 216, using e.g. bolts and nuts. For the embodiments, horizontal tie member 216 may span the cavity across a top-end of bracing arrangement 202. In various embodiments, horizontal tie member 216 may be configured such that it rides above the concrete with enough room for a tool to be inserted under it such that the concrete can be finished. For the embodiments, horizontal tie member 216 ties brace members 212 and 214 together at respective top ends of the members.

In alternate embodiments, horizontal tie member or members may tie members 212 and 214 at other respective positions, such as mid-sections or bottom ends additionally or instead (to be described more fully below). Further, in other alternate embodiments, members 212 and 214 may be respectively tied with one another, i.e., members 212 and 214 of one apparatus 100 may be respectively tied to members 212 and 214 of another apparatus 100 (not shown).

Figure 3:
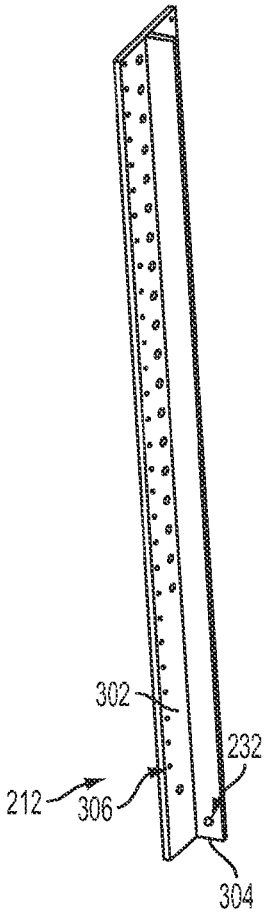
FIG. 3 illustrates a perspective view of the interior vertical brace member of the brace arrangement of FIG. 2, showing selective features of the member.
Figure 4:
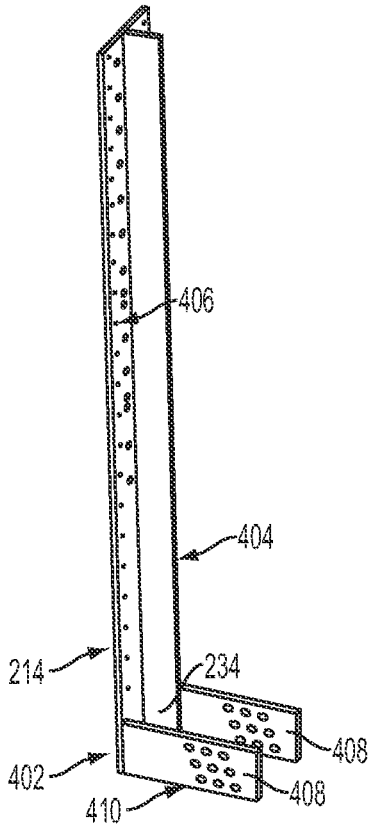
FIG. 4 illustrates a perspective view of the exterior vertical brace member of the brace arrangement of FIG. 2, showing selective features of the member.

Referring now also to FIG. 3-4, wherein a perspective view, one each, of the interior and exterior vertical brace members, showing selective features of the members, in accordance with various embodiments, are illustrated. As shown, interior vertical brace member 212 may include a longitudinal body 302 having a plurality of openings 306 to enable horizontal tie member 216 and members of the inner form 102*a* to be adjustably coupled to the interior vertical brace member 212. For the embodiments, interior vertical brace member 212 may further include spine 304 disposed substantially at the center spanning from the top end to the bottom end to strengthen the interior vertical brace member 212. Exterior vertical brace member 214 may include a longitudinal body 402 having a plurality of openings 406 to enable horizontal tie member 216 and members of the outer form 102*b* to be adjustably coupled to the exterior vertical brace member 214. Further, for the embodiments, exterior vertical brace member 214 may further include spine 404 disposed substantially at the center spanning from the top end to the bottom end to strengthen the interior vertical brace member 214. For the embodiments, exterior vertical brace member 214 may further include flanges 408 disposed at the bottom end, with each flange 408 having a plurality of openings 410 to enable adjustable coupling of base 204 to exterior vertical brace member 214 in one of a plurality of positions, using e.g. bolts and nuts.

In various embodiments, interior and exterior vertical brace members 212 and 214 may further include openings 232 and 234 to facilitate a bottom tie to be made, using e.g. a tie wire, tying the two members together to further strengthen the support the brace, kicker and tie apparatus provide to the form to keep the liquid concrete in the cavity to allow the liquid concrete to solidify over time. In other embodiments, other stronger bottom ties may be employed instead (to be described more fully below).

In alternate embodiments, interior and exterior vertical brace members 212 and 214, as opposed to the illustrated embodiments that utilize a single body with a spine to create a T-shaped structural member, may be respectively I-beams or variants of an I-shaped structural member, or channel stock or variants of a C or U-shaped structural member, or angle iron or variants of an L-shaped structural member, or round tubing or pipe or variants of a round structural member, or square or rectangular tubing or variants of a square or rectangular structural member, or a radius or variants of a contoured structural member, or a combination thereof to comprise the inner and outer brace structure, as appropriate to the geometry and/or strength requirements of cavity 104 and/or footing 106, to provide further supporting strength for the inner and outer forms 102*a* and 102*b*. Still, in other alternate embodiments, interior and exterior vertical brace members 212 and 214, as opposed to the illustrated embodiments having a single piece body, may comprise multiple portions removably and/or adjustably coupled together, using e.g. nuts and bolts, or telescopically nested within each other, allowing apparatus 100 to support taller forms or making it easier to transport the apparatus. For these embodiments, additional kickers may be employed to support the brace members 212 and/or 214, in particular, one kicker may be employed to support each segment of the brace members 212 and/or 214.

Figure 5:
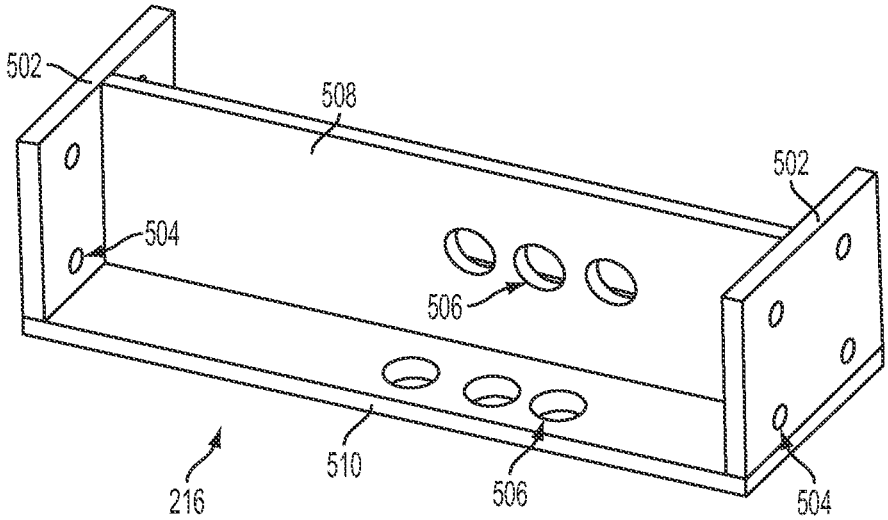
FIG. 5 illustrates a perspective view of the upper horizontal tie member of the brace arrangement of FIG. 2, showing selective features of the member.

FIG. 5 illustrates a perspective view of the horizontal tie member 216, showing selective features of the member, in accordance with various embodiments. Referring now to both FIGS. 2 and 5, horizontal tie member 216 may include a longitudinal body 510 having two flanges 502 disposed at the respective ends of body 510, with each flange 502 having a plurality of openings 504, to enable horizontal tie member 216 to be removably and adjustably coupled to the interior and exterior vertical brace members 212 and 214, using e.g. bolts and nuts. Further, for the embodiments, horizontal tie member 216 may further include spine 508 disposed substantially at the center spanning from the one end to the other end to strengthen the horizontal member 216. Horizontal tie member 216 may also include a number of openings 506 disposed on spine 508 and/or body 510 to enable flexible placement of e.g. concrete bolts in the concrete structure being formed.

In alternate embodiments, horizontal tie members 216 may be segmented and adjustable to provide different lengths to define different desired widths for cavity 104. In various embodiments, bracing arrangement 202 may include multiple horizontal tie members 216 of different lengths instead, to provide the various desired widths for cavity 104.

Figure 6:
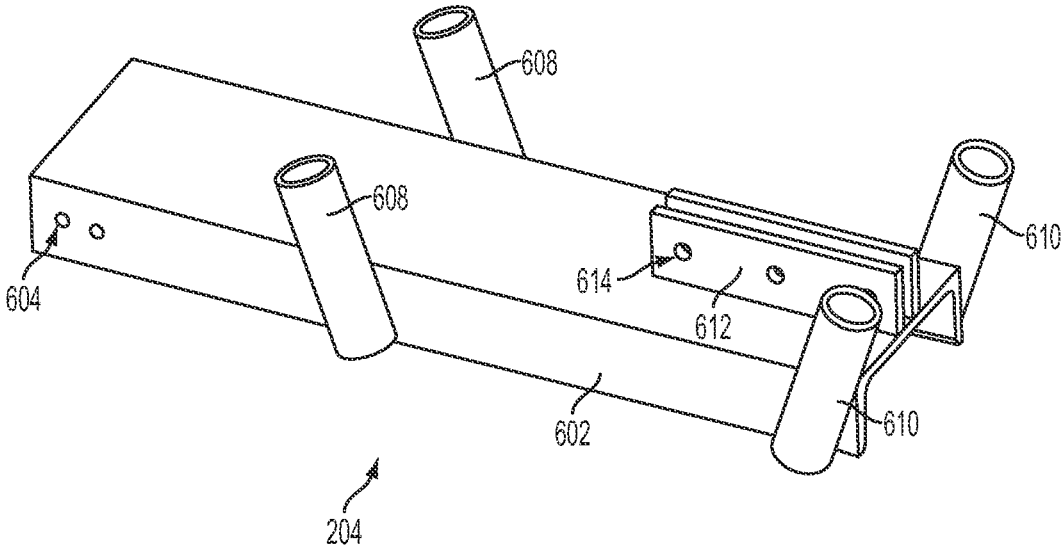
FIG. 6 illustrates a perspective view of the base of FIG. 1, showing selective features of the base.

FIG. 6 illustrates a perspective view of the base 204, showing selective features of the base, in accordance with various embodiments. Referring now to both FIGS. 2 and 6, base 204 may include body 602 having a channeled bottom. Body 602 may include a number of openings 604 on each side wall at one end to enable removable and/or adjustable coupling of base 204 to exterior vertical brace member 214, using e.g. bolts and nuts. Body 602 may further include a number of fins 612, each having a number of openings 614 to enable removable and/or adjustable coupling of base 204 to linearly adjustable kicker 206, using e.g. bolts and nuts. Body 602 may also include tubes 608 and 610. Tubes 610 may be disposed on opposite side of the far end (from the exterior vertical brace member 214, and inclining away from the exterior vertical brace member 214. Tubes 608 on the other end may be disposed on opposite side of body 601 closer in towards the exterior vertical brace member 214, and inclining towards the exterior vertical brace member 214. Both tubes 608 and 610 may have hollowed interior configured to receive soil nails, earth anchors or concrete stake to secure base 204, e.g. to the ground. In various embodiments, a soil nail may be a concrete stake or piece of rebar with a nut welded to the top to make a structure that is a large nail that can be driven into the soil.

Referring now to FIG. 2, linearly adjustable kicker 206 may be removably and/or adjustably coupled to exterior vertical brace member 214 at one end, and base 204 at the other end, using e.g. bolts and nuts. For the embodiments, linear adjustable kicker 206 may include a linearly adjustable arm 222 adjustably coupled to turnbuckle 224, which in turn is adjustably coupled to end piece 226. Turnbuckle 224 may include two threaded ends, left and right hand threaded. Linearly adjustable arm 222 may provide coarse adjustments while turnbuckle 224 may provide fine adjustments. The adjustments may be made even after kicker 206 has been coupled to base 204 and exterior vertical member brace 214, and base 204 has been secured, e.g. to ground. In addition to supporting brace members 212 and 214, linearly adjustable kicker 206 may also serve to facilitate alignment of brace members 212 and 214, ensuring they are substantially vertical within the precision desired.

Still referring to FIG. 2, the illustrated embodiments may be configured for intermediate height retaining walls. For the embodiments, the brace, kicker and tie apparatus may further include another linearly adjustable kicker 208. Linearly adjustable kicker 208 may include base plate 238, extensible arm 232, turnbuckle 234 and end piece 236. Base plate 238 may include features to enable kicker 208 to be secured, e.g. to ground, and features to enable the extensible arm 232 to be pivotally or rotatably coupled to base plate 238. At the other end, extensible arm 232 may be adjustably coupled to turnbuckle 234, which in turn may be adjustably coupled to end piece 236, which in turn may be removably coupled to exterior vertical member 214, using e.g. bolts and nuts. Extensible arm 232 may provide coarse adjustments while turnbuckle 234 may provide fine adjustments. In various embodiments, extensible arm 232 may include a number of nested telescopic tubes with openings to enable the tubes to be extended and locked into one of a plurality of different lengths, using e.g. one or more pins. Turnbuckle 234 may include threaded ends, left and right hand threaded.

In alternate embodiments, base plate 238 may also include tubes like tubes 608 and/or 610 to facilitate employment of soil nail, earth anchor or concrete stake to secure base plate 238 and kicker 208, e.g. to ground.

Figure 7:
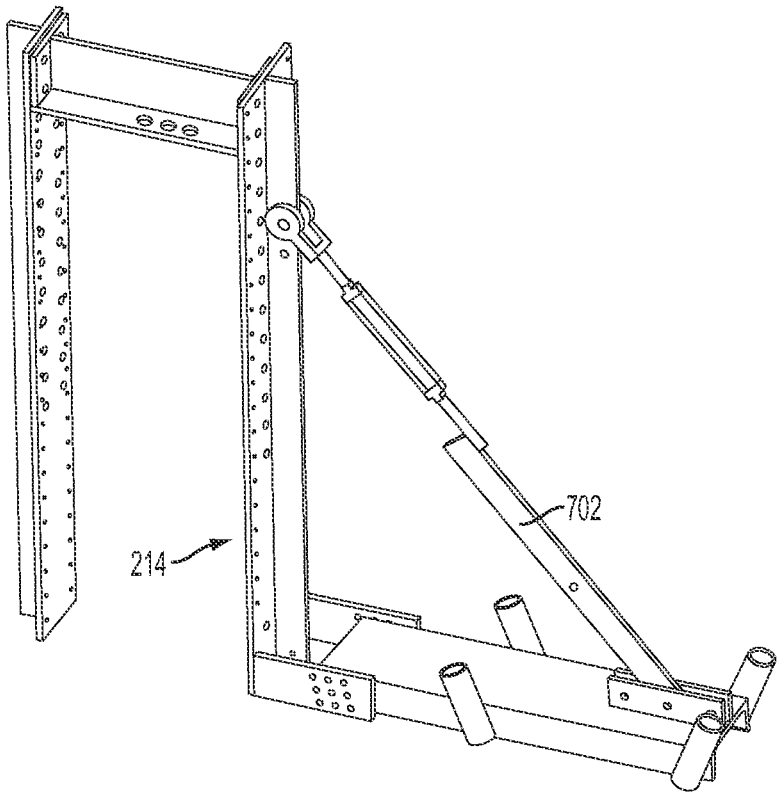
FIG. 7 illustrates a perspective view of another brace, kicker and tie apparatus of the present disclosure, showing selective elements of the apparatus.

For the embodiments, linearly adjustable kicker 206 may be coupled at approximately the mid-point between the top and bottom ends of exterior vertical member 214, while linearly adjustable kicker 208 may be coupled at about the top end of exterior vertical member 214. In alternate embodiments, for higher exterior vertical member 214, brace, kicker and tie apparatus may include one or more additional kickers, in addition to adjustable kickers 206 and 208. However, in shorter embodiments, as illustrated by FIG. 7, showing selective elements of the apparatus, brace, kicker and tie apparatus may be practiced with one adjustable kicker 702. For the embodiment, the single adjustable kicker 702 may be coupled to the exterior vertical member 214 near its top end.

In various embodiments, the earlier described parts may be constituted with metallic material to provide strength to support the form, enabling the brace, kicker and tie arrangement to be reusable, and reducing the amount of wood product waste. In alternate embodiments, other materials with similar tensile strength and reusable characteristics may be used instead, in part or in whole.

The dimensions of the various elements are application dependable, that is, dependent on the size of the brace and form the apparatus is designed to support. In various embodiments, the bracing arrangement may be approximately 4 ft tall×1 ft wide, whereas adjustable kicker 206 may be approximately 4 ft in length and adjustable kicker 208 may be approximately 8 ft in length. In alternate embodiments, the bracing arrangement and kickers may have different dimensions.

Figure 8:
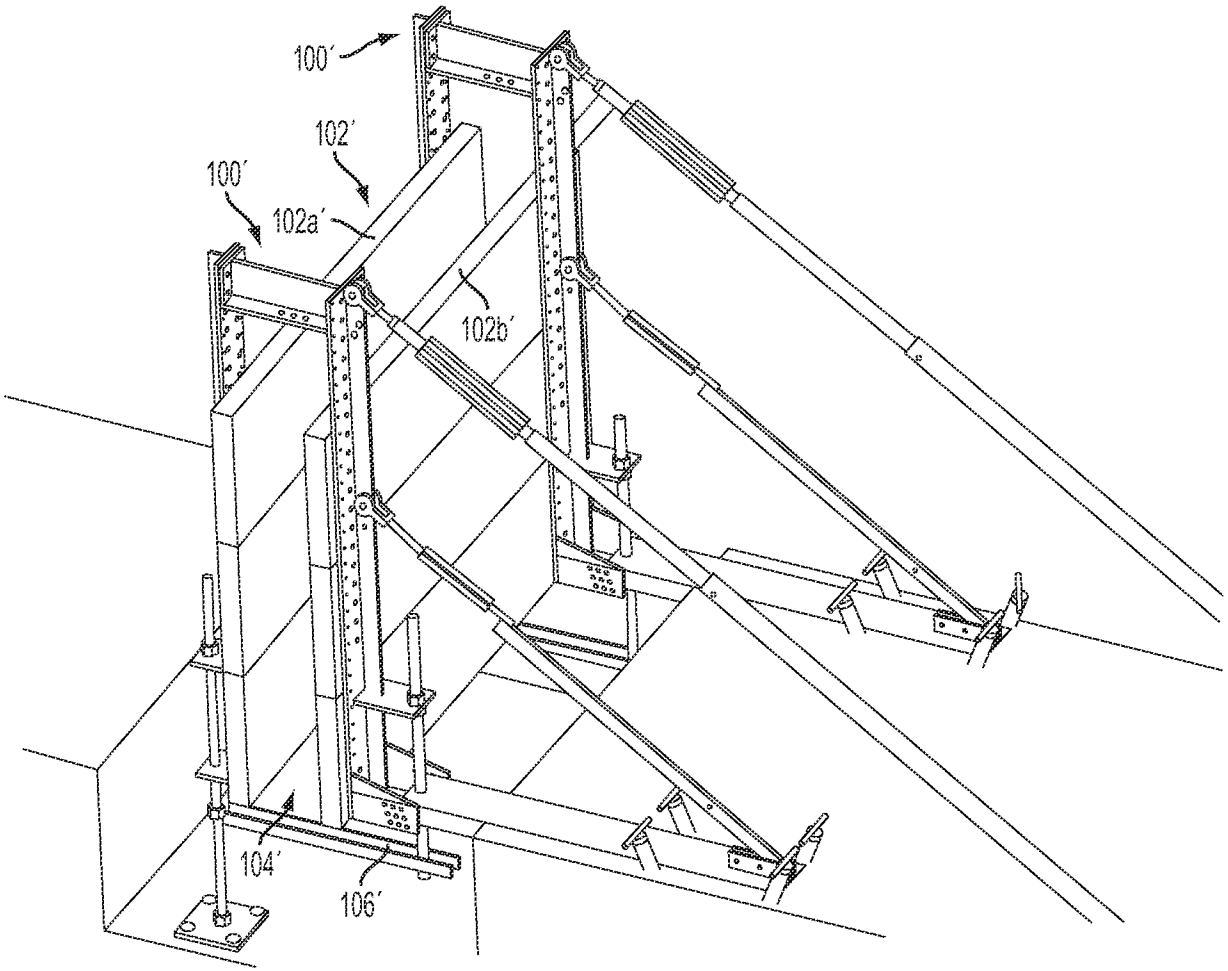
FIG. 8 illustrates a perspective view of another pair of brace, kicker and tie apparatuses, showing selective elements of the apparatuses.
Figure 9:
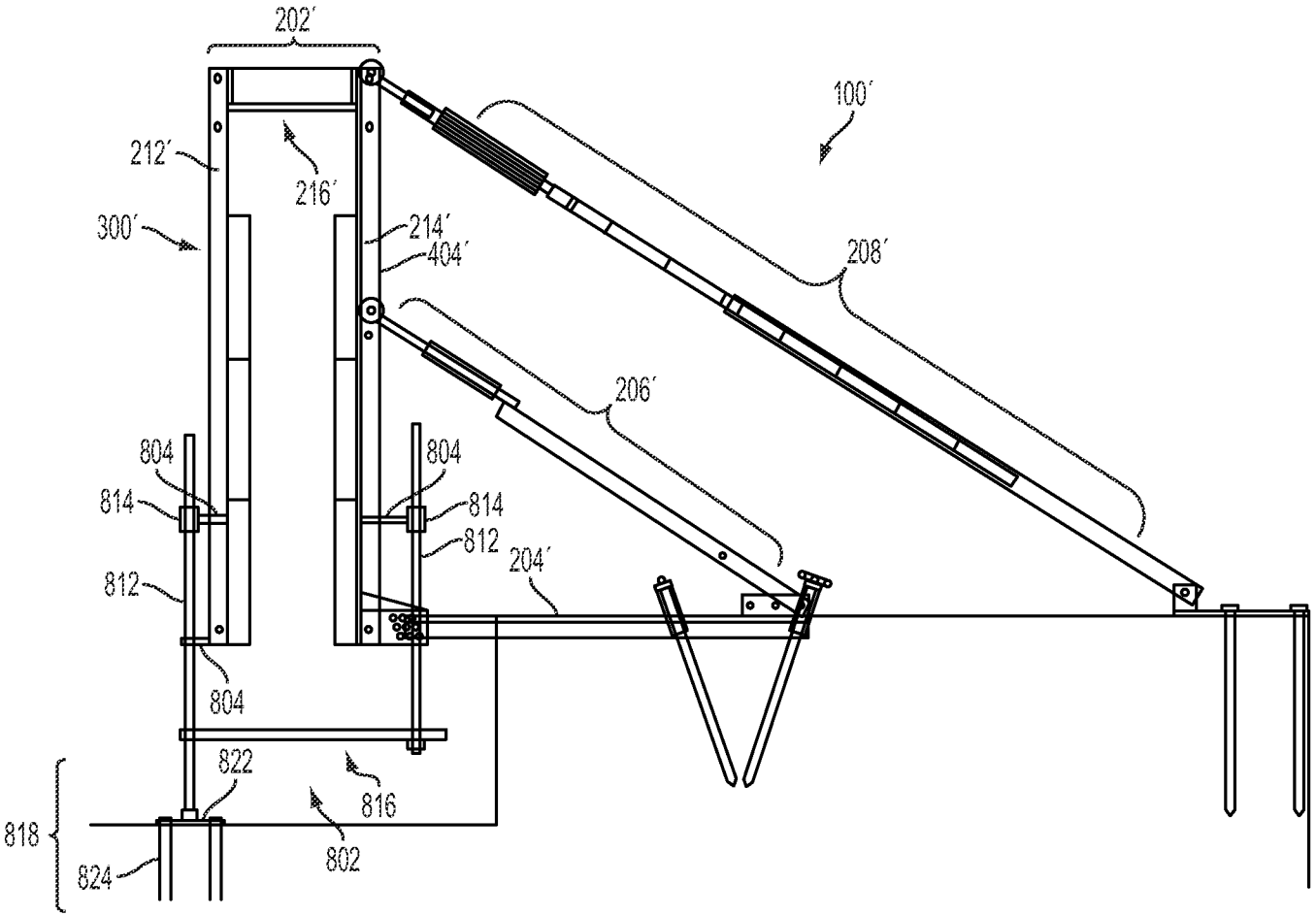
FIG. 9 illustrates a cross sectional view of one of the brace, kicker and tie apparatuses of FIG. 8, showing selective elements of the apparatus.

FIG. 8 illustrates a perspective view of another pair of brace, kicker and tie apparatuses of the present disclosure, showing selective elements of the apparatuses, and FIG. 9 illustrates a cross sectional view of one of the brace, kicker and tie apparatuses of FIG. 8, showing selective elements of the apparatus, all in accordance with various embodiments. As illustrated, similar to the pair of brace, kicker and tie apparatus 100 of FIG. 1, the pair of brace, kicker and tie apparatus 100' may be employed to support a section of a form 102' for forming a concrete structure, e.g. a retaining wall. Form 102' may include inner and outer form walls **102*a*' and 102*b*', hereinafter simply inner and outer form, defining cavity 104' for receipt of concrete in liquid form, holding the concrete, and allowing the concrete to solidify. Brace, kicker and tie apparatus 100' may include bracing arrangement 202'. In various embodiments, apparatus 100' may further include a base 204', a first linearly adjustable kicker 206', and/or a second linearly adjustable kicker 208', removably coupled to bracing arrangement 202' and/or each other as shown. Base 204', first linearly adjustable kicker 206', and second linearly adjustable kicker 208', may be similarly constituted as base 204, first linearly adjustable kicker 206, and second linearly adjustable kicker 208, earlier described for brace, kicker and tie apparatus 100**, accordingly will not be further described.

Bracing arrangement 202' may also be similarly constituted in part as bracing arrangement 202, having interior and exterior vertical brace member 212' and 214', and/or removably coupled together by top-end horizontal tie member 216'. However, for the embodiments, bracing arrangement 202' further includes bottom-end horizontal tie-arrangement 802. Further, interior and exterior vertical brace member 212' and 214' include additional features to facilitate removable and/or adjustable mating with bottom-end horizontal tie-arrangement 802. In particular, for the embodiments, interior and exterior vertical brace member 212' and 214' may include one or more fins 804 (also referred to as webs) extending orthogonally away from spines 304' and 404' respectively. Fins or webs 804 may include openings to facilitate removable and/or adjustable mating with horizontal tie-arrangement 802, using vertical tie members 812. In various embodiments, each vertical tie member 812 may be formed with a threaded rod that screws into a nut 814 welded at the top of platform 822, and a she-bolt (not shown) that runs vertically through both webs 804 and couples to the threaded rod, to enable each vertical tie member 812 to be removably and adjustably mated with interior or exterior vertical brace member 212' or 214'. In alternate embodiments, the threaded rod may be a part of chair 818 and stays in the pour, while the she-bolt is removed.

In various embodiments, bottom-end horizontal tie-arrangement 802 may include horizontal tie member 816 and chair 818. For the embodiments, horizontal tie member 816 may further include features, such as, openings, to facilitate horizontal tie member 816 to be adjustably mated with vertical tie members 812. For the embodiments, chair 818 may include platform 822 for mating with interior vertical tie member 812 and legs 824 for removably and/or adjustably anchoring horizontal tie-arrangement 802 to ground. Platform 822 may include a center opening to facilitate interior vertical tie member 812 to be removably and adjustably mated with chair 818. For the embodiments, legs 824 may be adjustable to enable bottom-end horizontal tie-arrangement 802 to be positioned at different desired heights off the ground. As those skilled in the art would appreciate, chair 818 can be designed to support a significant amount of weight, for example to carry the weight of the inner form structure, thus enabling it to play a dual role in supporting the inner form and resisting the pressure of the concrete.

In various embodiments, similar to apparatus 100, members 212', 214' and 816' of one apparatus 100' may be respectively tied to members 212', 214' and 816' of another apparatus 100'.

As those skilled in the art would appreciate, with the afore described features, the pair of brace, kicker and tie apparatus 100' may provide more supporting strength to allow for a taller cavity 104' to be poured in a given time. However, brace, kicker and tie apparatus 100' may nonetheless be more easily assembled and disassembled as compared to the prior art. In particular, most of bracing arrangement 202' may be disassembled and decoupled from horizontal tie member 816 and chair 818, leaving horizontal tie member 816 and chair 818 behind, buried inside the solidified concrete.

Figure 10:
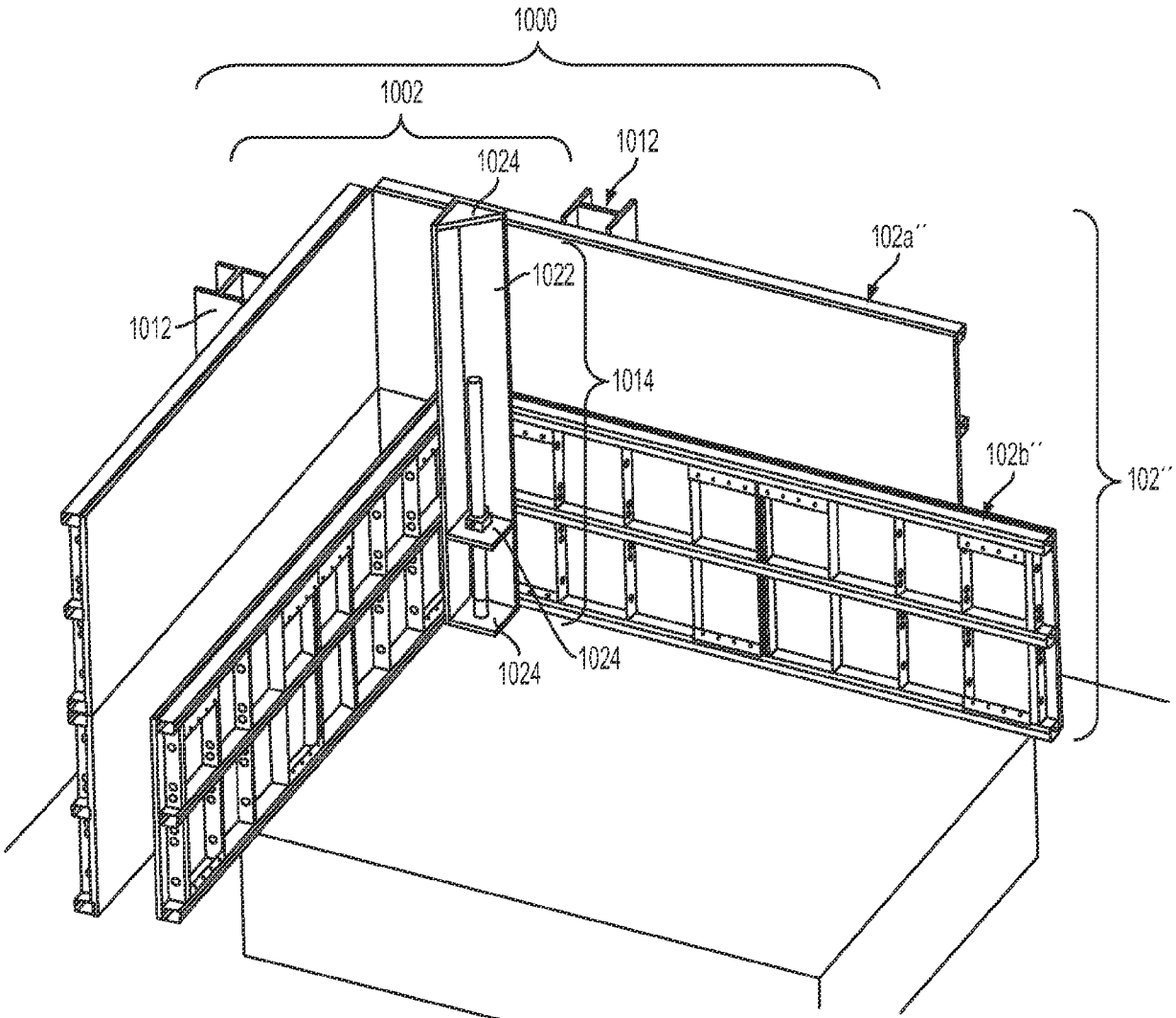
FIG. 10 illustrates a perspective view of still another set of brace, kicker and tie apparatuses, showing selective elements of the apparatuses.
Figure 11:
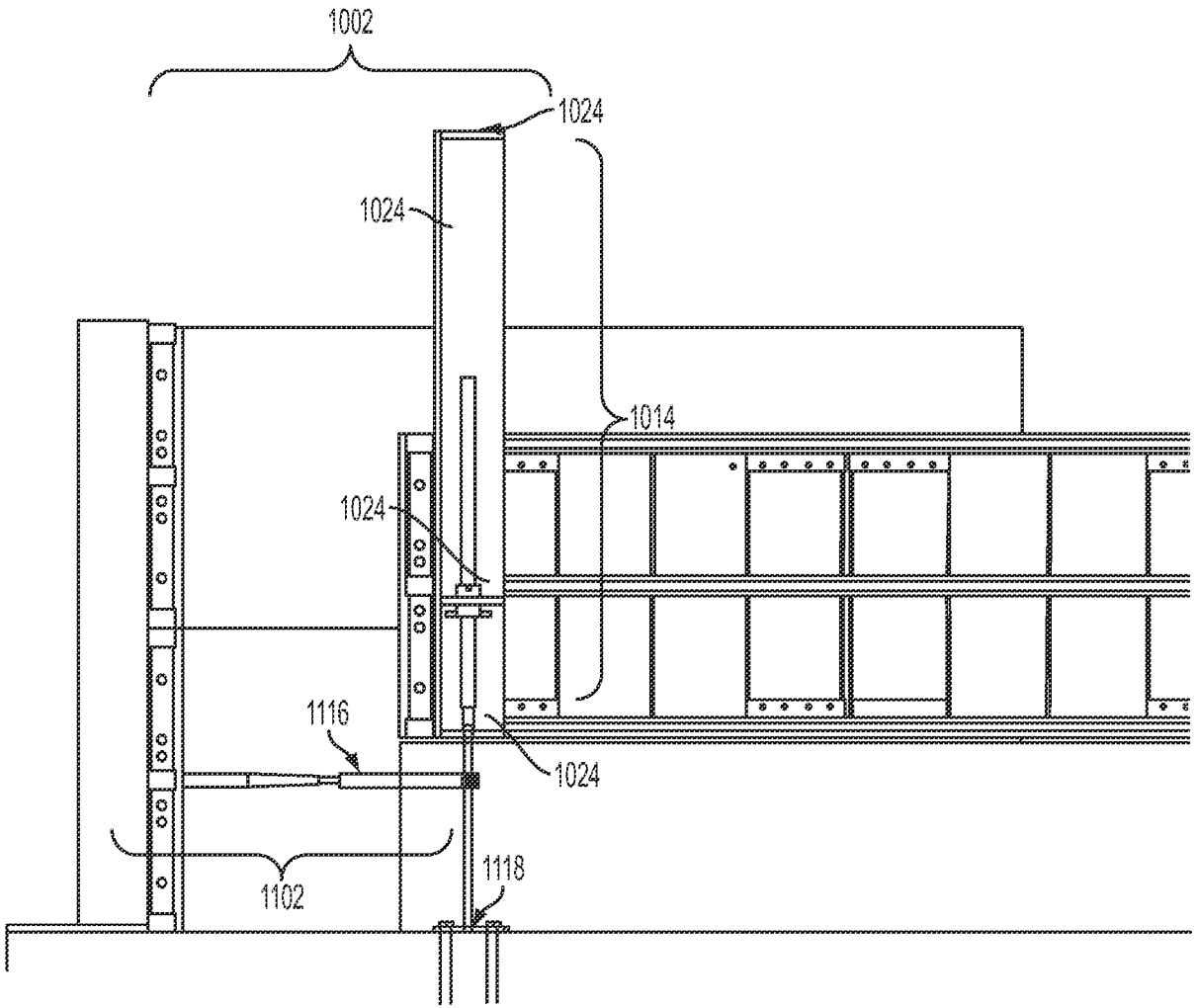
FIG. 11 illustrates a cross sectional view of the shared inner vertical bracing member of FIG. 10, showing selective features of the member.

FIG. 10 illustrates a perspective view of a pair of brace, kicker and tie apparatuses of the present disclosure, including a shared brace member, and FIG. 11 illustrates a cross sectional view of the shared brace member, both showing selective elements/features of the apparatuses/member, all in accordance with various embodiments. As illustrated, similar to the pairs of brace, kicker and tie apparatuses 100 and 100' of FIGS. 1 and 8, each brace, kicker and tie apparatus 1000 comprises bracing arrangement 1002. In various embodiments, apparatus 1000 may further comprises base and linearly adjustable kickers (both not shown). Except for apparatus 1000, unlike embodiments of 100 and 100', bracing arrangement 1002 comprises exterior vertical brace members 1012, and a shared common interior vertical brace member 1014. Further, exterior and interior vertical brace members include features making the pair of brace, kicker and tie apparatuses 1000 particularly suitable for providing support to inner and outer forms **102*a*" and 102*b*" at a corner where the forms come together. In alternate embodiments, bracing arrangement 1002** may comprise two interior vertical bracing members and a shared exterior bracing member instead.

In various embodiments, the bases, the kickers, and the top end ties of bracing arrangement 1002 may be substantially similar as the base, the kicker, and the top end tie earlier described. Accordingly, for clarity and ease of understanding, these elements are not shown in FIGS. 10 and 11, allowing FIGS. 10 and 11 to focus on the novel features of shared interior vertical brace member 1014 and shared bottom-end horizontal tie arrangement 1102.

As illustrated, for the embodiments, exterior vertical brace members 1012 may comprise of I-beams disposed with the arms of the I-beams orthogonal to the form wall. In alternate embodiments, the I-beams may be disposed with the center member orthogonal to the form wall instead. In various embodiments, shared interior vertical brace member 1014 may include an angled longitudinal body 1022. For the embodiments, angled longitudinal body 1022 may comprise a number of fins (or webs) 1024 located at the top end, mid-section (s) and/or the bottom end. The fin or web 1024 located at the top end (in conjunction with other apparatus 1000) may be employed to support a form panel employed to form e.g. a roof of a concrete structure, and/or in an alternate embodiment, can be used as a chair of another interior vertical brace member 1014 disposed on top (see brace cage description below for further detail), in a fashion similar to the function played by chair 818 and chair 1118. The fin or web 1024 located at the mid-sections may provide reinforcement or further strength for angled longitudinal body 1022. The fin or web 1024 located at the bottom end may include opening(s) to facilitate removable and/or adjustable mating with a bottom-end horizontal tie arrangement 1102. Similar to longitudinal body 402, angled longitudinal body 1022 may comprise a plurality of openings (not shown) to enable members of the outer form 102*b*" to be removably and/or adjustably coupled to the exterior vertical brace member 1014. In various embodiments, angled longitudinal body 1022 may also be provided with male/female couplers for coupling with form panels, such that interior vertical brace member 1014 may also serve as a stub tree. For further description of stub tree, see co-pending PCT application, PCT/US10/22774, entitled "Adjustable and/or Reusable Form Panel," and contemporaneously filed. Similar to bottom-end horizontal tie arrangement 802, bottom-end horizontal tie arrangement 1102 may include horizontal tie member 1116 and chair 1118. Chair 1118 may be similarly constituted as chair 818. Similar to chair 818, chair 1118 can be designed to support a significant amount of weight, for example to carry the weight of the inner form structure, thus enabling it to play a dual role in supporting the inner form and resisting the pressure of the concrete.

Figure 12B:
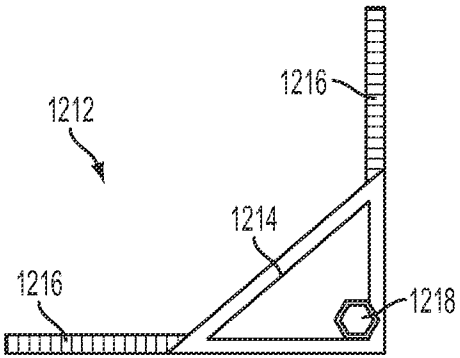
FIGS. 12*a*-12*b* illustrate top views of two variants of the horizontal tie member of the bottom-end horizontal tie arrangement of FIGS. 10 and 11, showing selected elements of the horizontal tie member.
Figure 12A:
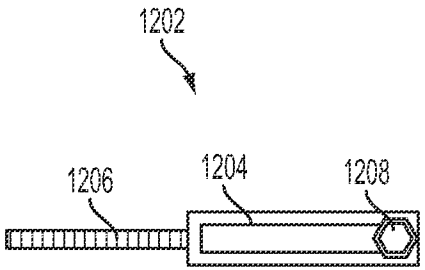

FIGS. 12*a* and 12*b* illustrate two variants of horizontal tie member 1116, showing selected elements of the bottom ties, in accordance with various embodiments. In various embodiments, horizontal tie member 1116 may be constituted with two of the horizontal tie members 1202 of FIG. 12*a*. Horizontal tie members 1202 may be employed to respectively couple the shared interior vertical bracing member 1014 to the two corresponding exterior vertical bracing members 1012. Each horizontal tie member 1202 may include a longitudinal main body 1204 having threaded rod 1206 disposed at one end, and nut 1208 disposed at the other end. Threaded rod 1206 may be configured to removably and/or adjustably couple exterior vertical brace member 1012 to horizontal tie member 1202, using e.g. a she-bolt. While nut 1208 may be configured to removably and/or adjustably couple shared interior vertical brace member 1013 to horizontal tie member 1202, using a threaded rod, thereby coupling an exterior vertical brace member 1012 to interior vertical brace member 1014.

In various embodiments, one horizontal tie member 1212 of FIG. 12*b* may be employed to respectively couple the shared interior brace member 1014 to the two corresponding exterior brace members 1012. Horizontal tie member 1212 may include a triangular main body 1214 having threaded rods 1216 extending orthogonally from two vertices, and nut 1218 disposed at the apex or third vertex of main body 1214. Threaded rods 1216 may be configured to removably and/or adjustably couple exterior vertical brace members 1012 to bottom tie 1212, using e.g. a she-bolt, while nut 1218 may be configured to removably and/or adjustably couple shared interior vertical brace member 1014 to horizontal tie member 1202, using e.g. a threaded rod and a she-bolt, thereby coupling the exterior vertical brace members 1012 to shared interior vertical brace member 1014.

It should be noted that while two variants of horizontal tie member 1202 and 1212 have been described, with the former having a longitudinal main body 1204, and the latter having a substantially triangular shaped body 1214, embodiments of the present disclosure are not so limited. In various embodiments, if needed, it is contemplated that the main body of the horizontal tie member may be of any one of a number of shapes having 2 or more end/corner points or vertices, e.g. rectangular, polygon, hexagon, and so forth. For example a four point horizontal tie member may be particularly useful when apparatus 1000 is used in conjunction with the employments of a stub tree to join the form panels together.

Similarly, while the present disclosure has been described thus far with embodiments where the inner and outer forms set at approximately the same height above the bottom of a footing, the present disclosure is not so limiting, and may be practiced e.g. with the outer form 102*a*" touching and extending from the ground, as illustrated in FIG. 11, using various embodiments of bottom-end horizontal tie arrangement 1102.

Figure 13:
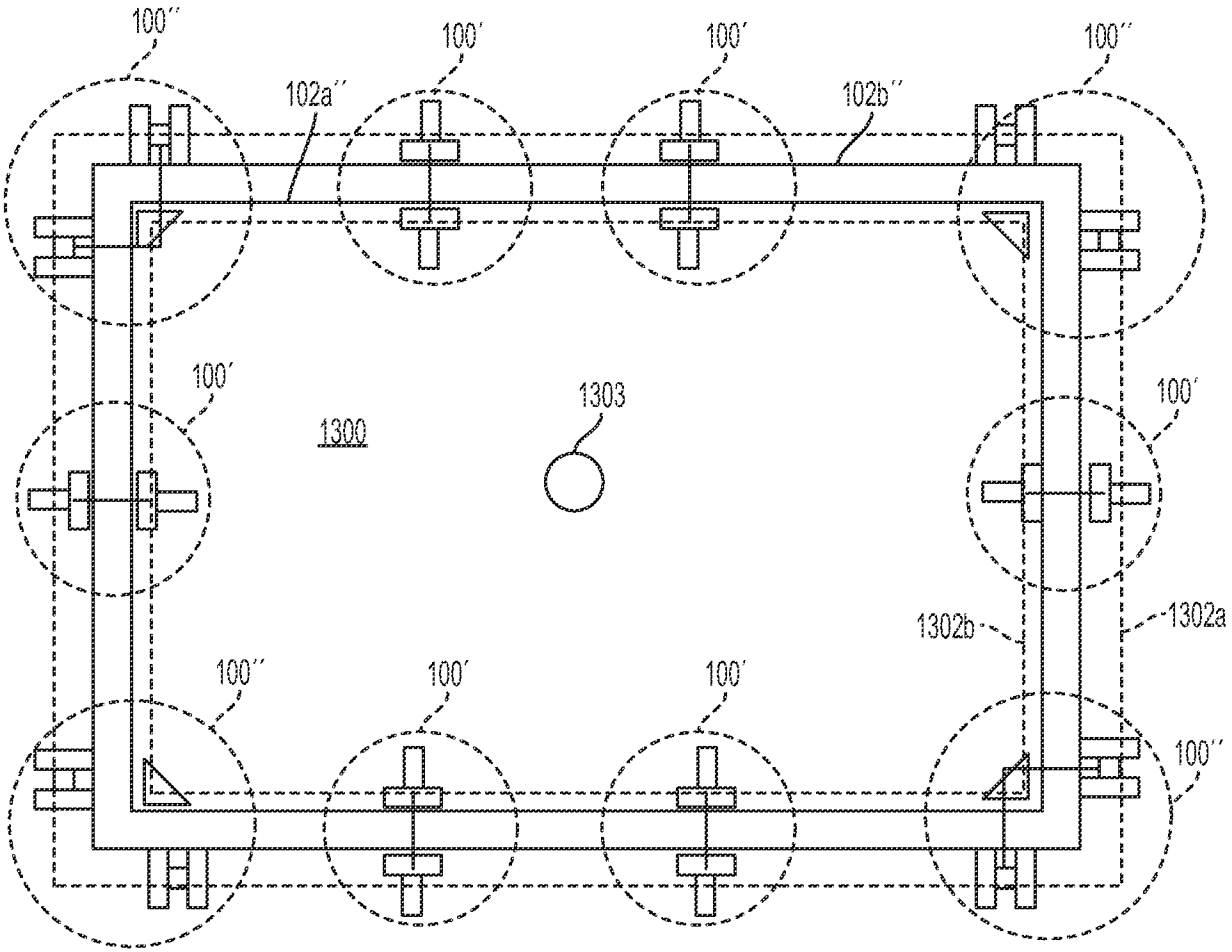
FIG. 13 illustrates an example bracing cage formed using the apparatuses of FIGS. 8 and 10, showing selected features of the bracing cage, with all of the foregoing arranged in accordance with various embodiments of the present disclosure.

FIG. 13 illustrates a top view of an example bracing cage formed using the apparatuses of FIGS. 8 and 10, showing selected features of the bracing cage, according to various embodiments of the present disclosure. As shown, with the novel apparatuses of the present disclosure, such as apparatuses 100" and apparatus 1000, a bracing cage 1300 with vertical brace members respectively bottom tied to each other, may be formed (sum of all the dotted circles shown in FIG. 13). Vertical brace members that are part of the dotted rectangle 1302*a* may be considered an outer brace cage, while vertical brace members that are part of the dotted rectangle 1302*b* may be considered an inner brace cage. As those skill in the art would now appreciate, such bracing cage 1300 may provide support for inner and outer forms 102*a*" and 102*b*"defining a desired concrete structure to be formed, allowing minimal or even no ties to be employed to tie the form panels to each other, in particular, when form panels from the novel form system disclosed in co-pending PCT application, PCT/US10/22774 are used. PCT Application PCT/US10/22774 is entitled "Adjustable and/or Reusable Form Panel," and contemporaneously filed. Bracing cage 1300 may be assembled and disassembled relatively easy, and apparatuses 100' and 1000 employed may be reused. The bracing cage 1300 shown is merely illustrative, other bracing cages of other shapes for forming other concrete structures may be formed using apparatuses 100, 100' and 1000.

As will be also appreciated by those of ordinary skill in the art, the various features of the brace, kicker and tie apparatus of the present disclosure enables a brace, kicker and tie arrangement to be formed efficiently, potentially with one person, resulting in substantial saving in labor. In particular, for certain concrete structures, such as a retaining wall having a footing, or a retaining wall over a slab such as in a basement, the brace, kicker, and tie apparatus of the present disclosure makes a single, "monolithic" pour practical and feasible rather than having to pour the footing/slab and retaining wall in two separate pours.

Further, with proper sizing of the brace, kicker et al elements and/or additional inter-coupling between adjacent braces and/or bottom-ties, bracing cage 1300 may support the weight of a slab above the footing/slab/wall combination, thus making it possible to pour a complete building structure with a roof monolithically.

Still further, by extending the process, and forming another inner cage 1300' on top of the first cage formed, and with proper scaling, it is contemplated that a two-story building may be formed and poured monolithically, using the novel apparatuses of the present disclosure. It is further contemplated that selective elements of the apparatus of the present disclosure may be left behind inside the concrete on purpose to provide further support, in the case of e.g. a single or multi-story building structure. For example, a column 1303 placed in the middle of brace cage 1300 could be left behind in a pour on purpose to serve as a mid-span column to provide support for a concrete ridge beam for a gable of a gable roof house. By purposely placing and then leaving this column to become part of the concrete building structure, this example of a brace that was necessary for the formwork could also reduce the size of the ridge beam required for the building structure, or multiple braces positioned properly may eliminate the need for a ridge beam. In various embodiments, the coupling of the inner form walls may be so strengthened, such that the inner form walls may be employed to support inner brace cage 1302*b* (as opposed the inner brace cage 1302*b* supporting the inner form walls), thereby enabling the inner brace cage 1302*b* to provide greater support for the roof of the concrete building structure being poured. In various embodiments, a substantially rectangular shaped composite form, constructed using the teachings of above mentioned co-pending PCT application, PCT/US10/22774, that was strongly coupled to the bracing elements of inner brace cage 1302*b*, could be employed solely, or in conjunction with additional supporting elements, to support inner brace cage 1302*b* (as opposed to inner brace cage 1302*b* supporting the inner form walls), thereby enabling the inner brace cage 1302*b* to provide greater support for the gravity load of the roof of the concrete building structure being poured.

Still in other embodiments, outer brace cage 1302*a* may be scaled up vertically, e.g. to twice the height of inner brace cage 1302*b*, thereby, the scaled up outer brace cage 1302*a* may be used in conjunction with two inner brace cages 1302*b*, one disposed on top of the other and separated by floor form walls, to enable a two-story building structure to be poured in a single monolithic pour.

Equally significant, after the desired concrete structure has been formed, the brace, kicker and tie arrangement can be disassembled relatively easily, e.g., by one person, as unlike the prior art approach where some of the wood stakes will be partially trapped in the solidified concrete requiring the wood stakes to be broken to remove the protruding portions, the brace, kicker and tie apparatus of present disclosure may be quickly disassembled without any components trapped in the solidified concrete. Accordingly, the apparatus may be reused to support another brace to support another form for forming another concrete structure.

Thus, embodiments of an adjustable and reusable brace, kicker and tie apparatus have been described. Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of the disclosure. Accordingly, those with skill in the art will readily appreciate that embodiments of the disclosure may be implemented in a wide variety of ways. This application is intended to cover any adaptations or variations of the embodiments discussed herein. Therefore, it is manifestly intended that embodiments of the disclosure be limited only by the claims and the equivalents thereof.

What is claimed is:

1. An apparatus comprising:

a horizontal tie member configured to tie an interior vertical brace member and an exterior vertical brace member of a brace arrangement at respective bottom ends of the brace members, with the interior vertical brace member hanging from another horizontal tie member tying the interior and exterior brace members of the brace arrangement at respective top ends of the brace members; and a chair configured to support the hanging interior vertical brace member; wherein the chair includes features for removably or adjustably secure the chair to ground at various heights off the ground.

2. The apparatus of claim 1, wherein the horizontal tie member comprises a longitudinal body, a threaded rod disposed at a first end of the body, configured to removably or adjustably couple the horizontal tie member with the hanging interior vertical brace member of the brace arrangement, and a nut disposed at a second end of the body configured to removably or adjustably couple the horizontal tie member with the exterior vertical brace member of the brace arrangement.

3. The apparatus of claim 1, wherein the horizontal tie member is further configured to tie another exterior vertical brace member of the brace arrangement with the hanging interior vertical brace member of the brace arrangement, at respective bottom ends of the another exterior vertical brace member and the interior vertical brace member of the brace arrangement.

4. The apparatus of claim 3, wherein the horizontal tie member comprises a triangular body, a first and a second threaded rod disposed respectively at a first and a second end of the body, configured to removably or adjustably couple the horizontal tie member with the exterior vertical brace members of the brace arrangement, and a nut disposed at a third end of the body configured to removably or adjustably couple the horizontal tie member with the hanging interior vertical brace member of the brace arrangement.

5. An apparatus comprising:

an interior vertical brace member having a web disposed at a top-end of the interior vertical brace member;

an exterior vertical brace member;

another exterior vertical brace member; and a horizontal tie arrangement, including at least a horizontal tie member configured to removably or adjustably couple the interior vertical brace member and at least one of the exterior vertical brace members at respective bottom ends of the brace members to brace an inner and an outer form for forming a concrete structure.

6. The apparatus of claim 5, wherein at least one of the interior or exterior vertical brace members of the brace arrangement includes a fin having an opening configured to accommodate a vertical tie member configured to removably or adjustably couple the corresponding interior or exterior vertical brace member to the horizontal tie member.

7. The apparatus of claim 5, wherein at least one of the interior or exterior vertical brace members of the brace arrangement includes a T-shaped longitudinal body having a spine running along a center axis of the longitudinal body.

8. The apparatus of claim 5, wherein the interior vertical brace member is hanging from another horizontal tie member tying the interior and at least one of the exterior brace members of the brace arrangement at respective top ends of the brace members; and the apparatus further comprises a chair configured to be removably or adjustably coupled to, and support the hanging interior vertical brace member.

9. The apparatus of claim 8, wherein the chair further includes features for removably or adjustably secure the chair to ground at various heights off the ground.

10. The apparatus of claim 5, wherein the horizontal tie member comprises a longitudinal body having a threaded rod disposed at one end and configured to removably or adjustably couple the horizontal tie member with the interior vertical brace member of the brace arrangement, and a nut disposed at another end configured to removably or adjustably couple the horizontal tie member with one of the exterior vertical brace members of the brace arrangement.

11. The apparatus of claim 5, wherein the interior vertical brace member comprises an I-beam.

12. The apparatus of claim 5, wherein at least one of the exterior vertical brace members comprises an angular shaped longitudinal body.

13. The apparatus of claim 5, wherein the horizontal tie arrangement further comprises another horizontal tie member configured to removably or adjustably couple the interior vertical brace member and the other exterior vertical brace member at respective bottom ends of the interior vertical brace member and the other exterior vertical brace member.

14. The apparatus of claim 13, wherein at least one of the horizontal tie members comprises a longitudinal body having a thread rod disposed at one end configured to removably or adjustably couple the one horizontal tie member with one of the exterior vertical brace members, and a nut disposed at another end to accommodate a vertical tie member to removably or adjustably couple the one horizontal tie member to the interior vertical brace member.

15. The apparatus of claim 5, wherein the horizontal tie member comprises a triangular body having thread rods extending orthogonally from first and second vertices for removably or adjustably coupling the horizontal tie member with the exterior vertical brace members, and a nut disposed at a third vertex to removably or adjustably couple the horizontal tie member with the interior vertical brace member.

16. The apparatus of claim 5, wherein the exterior vertical brace member includes features to removably or adjustably accept a kicker in one of a plurality of positions.

17. An apparatus comprising:

a bracing arrangement configured to form or contributing in forming a bracing cage in support of an inner and an outer form wall of a form for forming a concrete structure, wherein the bracing arrangement comprises:

an interior vertical brace member, a first exterior vertical brace member, a second exterior vertical brace member, a horizontal tie arrangement, including a horizontal tie member configured to removably or adjustably couple the first and second exterior vertical brace members and the interior vertical brace member at respective bottom ends of the first and second exterior vertical brace members and the interior vertical brace members;

wherein the horizontal tie member comprises a triangular body having thread rods extending orthogonally from first and second vertices for removably or adjustably coupling the horizontal tie member with the first and second exterior vertical brace members, and a nut disposed at a third vertex to removably or adjustably couple the horizontal tie member with the interior vertical brace member.

18. The apparatus of claim 17, wherein the interior vertical brace member is hanging from another horizontal tie member tying the interior and at least one of the exterior brace members of the brace arrangement at respective top ends of the brace members; and the apparatus further comprises a chair configured to be removably or adjustably coupled to, and support the hanging interior vertical brace member.

* * * * *